US006216886B1

(12) United States Patent
Considine

(10) Patent No.: US 6,216,886 B1
(45) Date of Patent: Apr. 17, 2001

(54) POST-MOUNTED HANGING DEVICE

(76) Inventor: Clifford J. Considine, 3508 Deep Valley Trail, Plano, TX (US) 75023

( * ) Notice: Subject to any disclaimer, the term of this patent is extended or adjusted under 35 U.S.C. 154(b) by 0 days.

(21) Appl. No.: 09/621,033

(22) Filed: Jul. 21, 2000

Related U.S. Application Data

(60) Provisional application No. 60/145,182, filed on Jul. 22, 1999.

(51) Int. Cl.[7] ..... A47G 29/00; A47F 5/06

(52) U.S. Cl. ..... 211/85.23; 211/196; 211/205; 248/219.2

(58) Field of Search ..... 211/205, 85.23, 211/85.3, 196, 110, 119.01, 30, 33, 163; 248/219.2, 339, 292.12

(56) References Cited

U.S. PATENT DOCUMENTS 2,065,622 * 12/1936 Smith ..... 211/205
2,186,543 * 1/1940 Henry ..... 472/15
4,117,630 * 10/1978 Kalas ..... 47/67
4,364,496 * 12/1982 Bridgeman ..... 223/88
5,226,622 * 7/1993 Leanna ..... 248/183.2
5,535,895 * 7/1996 Valiulis ..... 211/59.1
5,561,969 * 10/1996 Sandy ..... 56/13.6
5,699,989 * 12/1997 Guthrie ..... 248/219.2

* cited by examiner

*Primary Examiner*—Jerry Redman
*Assistant Examiner*—Gregory J. Strimbu
(74) *Attorney, Agent, or Firm*—Jeffrey T. Hubbard; H. Dennis Kelly

(57) ABSTRACT

A hanger adapted to attach to a post has a skirt attached to the bottom side of a substantially horizontal base plate having a hole defined therein. A tubular sleeve is attached to the base plate just below the hole. The end of the sleeve distant from the base plate hole is capped by a stop plate. A pole rests on the stop plate in the sleeve and extends upward through the hole in the base plate. A number of arms are attached to the top of the pole and extend radially away from it. A projection on the pole is designed to fit within gaps defined between a number of stops attached to the base plate. The pole is set to different positions by raising the pole until the projection is above a gap, turning the pole until the projection is over a different gap, and lowering the pole back down such that the projection rests within the different gap.

8 Claims, 2 Drawing Sheets

POST-MOUNTED HANGING DEVICE

This application is a non-provisional application of co-pending provisional application Serial No. 60/145,182, filed on Jul. 22, 1999.

BACKGROUND OF THE INVENTION

1. Field of the Invention

This invention relates in general to hangers. In particular, the invention relates to a hanger designed for being mounted atop a post, especially a fence post, and having means for hanging objects that can be placed in several different positions.

2. Description of the Related Art

Hangers for plants and other objects are well known. Generally, hangers are attached to walls and other flat surfaces. A hanger that could be attached to an upright post, especially a fence post, would be desirable for hanging plants and decorative objects. In addition, a hanger that allowed the objects hanging from the hanger to be rotated, similar to a Lazy Susan, would be desirable. This would allow, for example, several plants to be hung from a fence post and allow access to plants on both sides of the fence for watering without having to travel around to both sides of the fence. However, the hanger should not be moved by natural forces such as wind. To the inventor's knowledge, no hanger presently exists that incorporates all these features and advantages.

SUMMARY OF THE INVENTION

In general, a structure having the desired features is achieved by a substantially horizontal base plate, attached to means such as a skirt extending below the base plate for affixing the device to a post. A tubular sleeve located just below the base plate retains the bottom part of a pole that stands upright in the sleeve, with most of the pole's length extending above the base plate. A number of arms extend radially out from the post and are adapted for hanging objects. In the preferred embodiment, the end of the sleeve distant from the base plate is capped with a stop plate, on which the pole rests.

A number of stops are attached to the base plate in a pattern about the pole. The stops are arranged so that gaps exist between adjacent stops. A projection extending radially from the pole is adapted to fit within the gaps between adjacent stops. The pole is moved from one gap to another by lifting the pole vertically in the tubular sleeve until the projection clears the stops, then turning the pole so that the projection is above another gap, and lowering the pole back down to a rest position.

Additional features and advantages of the invention will become apparent in the following detailed description and in the drawings.

DESCRIPTION OF THE PREFERRED EMBODIMENT

Figure 1:
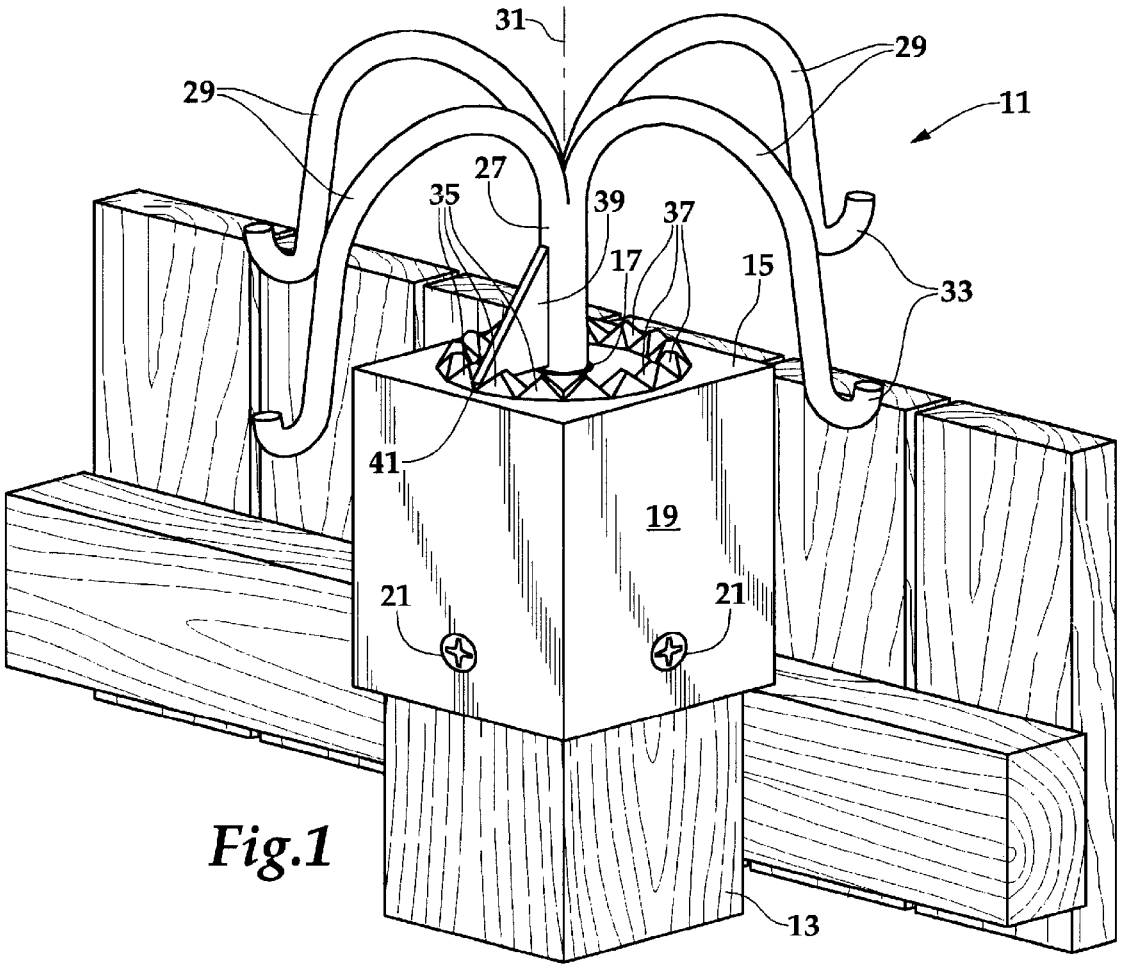
FIG. 1 is an upper perspective view of hanger according to the invention, installed atop a solid wooden post.
Figure 2:
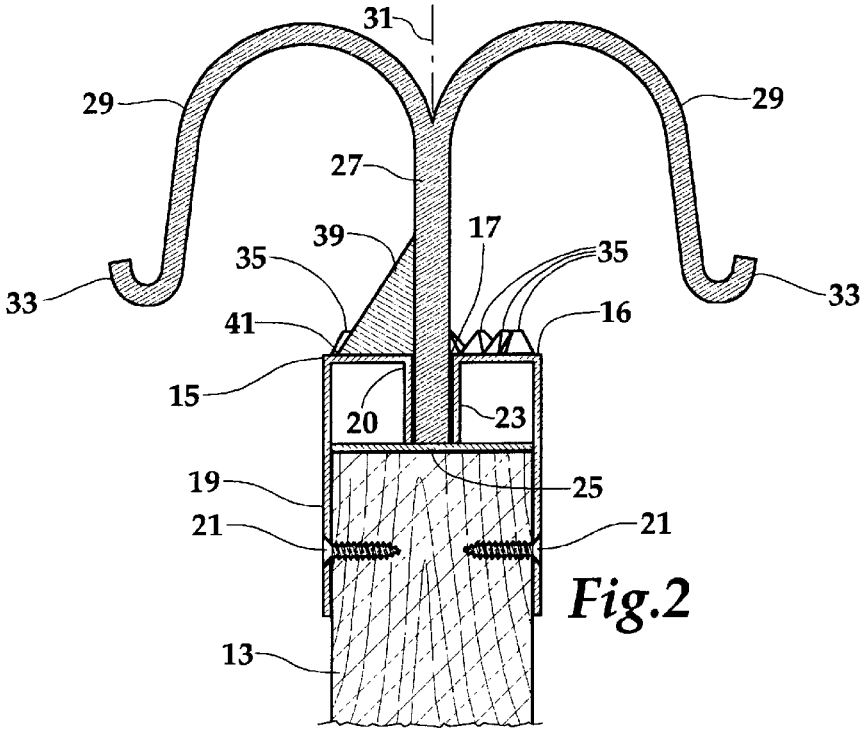
FIG. 2 is a cross-sectional front elevation thereof.

FIGS. 1 and 2 show one embodiment of a post hanger 11 of the invention, installed on a solid wooden post 13. While the post 13 is shown with a square cross-section, round posts and posts with other cross-sectional shapes are also envisioned for use with the hanger 11. The hanger 11 includes a substantially horizontal base plate 15 having a hole 17 defined roughly in the center of the base plate, and a skirt 19 below the base plate 15 that is adapted to fit over and around the top of the post 13. The skirt 19 provide the means to fix tie base plate 15 to the post 13. The skirt is preferably secured by attaching hardware such as set screws 21. The top surface 16 of the base plate 15 is shown flat, but can have other shapes, such as being generally convex. Regardless of the particular configuration, the base plate 15 is substantially horizontal.

A tubular sleeve 23 is attached at one end to the bottom side of the base plate 15, in line with the hole 17. The other end of the sleeve 23 is capped by a stop plate 25. The combination of the tubular sleeve 23 and the stop plate 25 provides the means to hold a pole 27 that extends upward through the base plate hole 17.

At least one, and preferably a number of arms 29 extend from the top end of the pole 27, generally in a radial direction from the pole's central axis 31. The arms are all shown having an arcuate shape for aesthetic purposes; other shapes can be used. When there is more than 25 one arm, the arms 29 can differ from each other in shape and length, and can attach to the pole 27 at different heights above the base plate 15. Each arm 29 has a crook 33 at the end of the arm 29 distant from the pole 27, so that an object can hang from the arm 29 without sliding off. Hooks, eyeholes, or other devices known in the art for hanging objects can also be used, and more than one device can be used per arm.

The stop plate 25 preferably extends toward and attaches to the skirt 19. This structure helps relieve stress that develops at the junction 20 of the tubular sleeve 23 and the base plate 15 when the load on the pole 27 (i.e. the weight of the objects hanging from the arms) is unbalanced.

The pole 27 can rotate freely in the tubular sleeve 23, and can also be moved vertically within the sleeve 23. As shown, the pole 27 can be easily removed from the sleeve 23. Alternative embodiments are envisioned wherein the pole is prevented from being removed from the sleeve, but can still rotate and move vertically within the sleeve 23. Vertical movement of the pole 27 is required to adjust the position of the pole, as will be discussed below.

A number of stops 35 are attached to the base plate 15, each stop about the same radial distance from the pole axis 31. The stops 35 are generally pyramidal in shape, but other shapes can be used. Also, each stop 35 is shown with the edges of their base just touching the edges of the bases of adjacent stops. An angular gap 37 is thus defined between adjacent stops. When stops having vertical sides are used, then the stops 35 must be spaced apart to forms gaps 37. The stops are preferably equally spaced from each other about the pole 27, but other arrangements can be used, such as a number of pairs of closely spaced stops, each pair being separated from adjacent pairs of stops by a distance that is substantially greater than the gap between the stops in each pair.

A triangular projection 39 is attached to the pole 27 just above the base plate 15. The projection 39 is designed to extend between the stops 35 and rest within the gaps 37. The projection 39 is shown with a flat bottom 41, but an angular bottom shaped to match the angular gaps 37 can also be used. The entire projection 39 can have other shapes as well. The projection 39, the stops 35, and the gaps 37 together provide means for holding the pole 27 in one of a number of positions, at different angles about the pole's axis 31. To change positions, the pole 27 is grasped and raised vertically until the projection 39 is completely out of the gap 37 in which it rested. The pole is then rotated until the projection 39 lines up with another gap 37, and the pole 27 is lowered back down. While the pole 27 preferably rests on the stop plate 25, the projection 39 can be located on the pole so that the projection rests on the base plate 15 (or in this case, on the stops 35 within the gap 37) instead. The weight of the pole 27 and any objects hanging from it bias the pole downwards to hold it in place.

Figure 3:
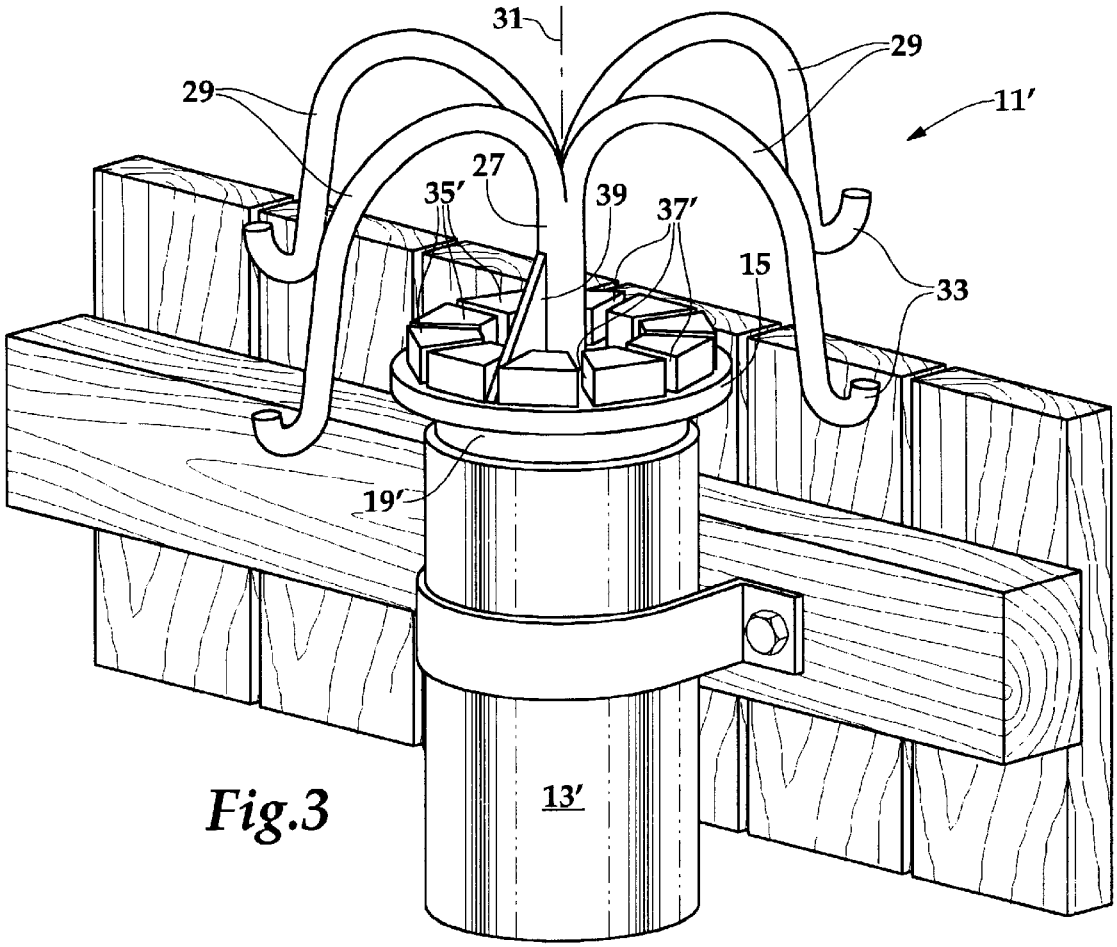
FIG. 3 is an upper perspective view of an alternative embodiment of the hanger partially installed atop a hollow metal post.
Figure 4:
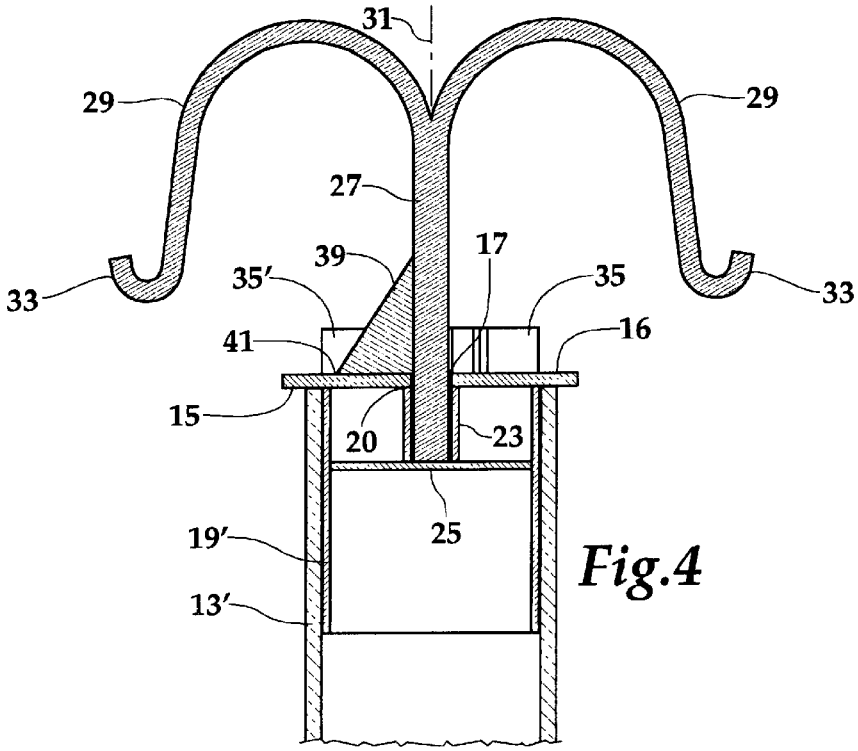
FIG. 4 is a cross-sectional front elevation of the alternative embodiment, when fully installed on the post.

FIGS. 3 and 4 show another embodiment of the invention. Only the material differences from the embodiment of FIGS. 1 and 2 will be discussed.

In this embodiment, the hanger 11' is adapted to sit atop a tubular post, such as a metal post for a chain link fence. The skirt 19' is designed to fit into the post 13', rather than outside it. No screws are used to attach the skirt 19' to the post 13' in this embodiment, but the weight of the hanger 11' will keep the hanger in place.

The stops 35' in this embodiment are shaped like truncated wedges with vertical sides. Since the stops have vertical sides, they are separated from each other to form gaps 37' for retaining the projection 39.

The invention has been shown in two embodiments. It should be apparent to those skilled in the art that the invention is not limited to these embodiments, but is capable of being varied and modified without departing from the scope of the invention as set out in the attached claims.

What is claimed is:

1. A hanger for use with an upright post, comprising:

a substantially horizontal base plate;

a pole having an axis, and extending upright through a hole defined in the base plate;

anchoring means for attaching the hanger to a vertical surface of the post such that the base plate is atop the post;

means for supporting the pole, while still allowing the pole to be turned about the axis and to be moved along the axis;

hanging means for hanging objects from the hanger; and position retaining means for holding the pole in one of a number of specific, predetermined positions relative to the base plate.

2. A hanger as recited in claim 1, wherein the anchoring means is a skirt located below the base plate.

3. A hanger as recited in claim 1, wherein the hanging means is at least one arm extending from the pole.

4. A hanger as recited in claim 1, wherein the means for supporting the pole comprises a tubular sleeve located below and extending downward from the hole defined in the base plate, and a stop plate attached to an end of the sleeve distant from the base plate.

5. A hanger as recited in claim 1, wherein the position retaining means comprises a projection attached to the pole above the base plate and a number of stops attached to the base plate and disposed radially about the pole; each stop being separated by a gap from an adjacent said stop; the projection being adapted to fit within each of the gaps.

6. A hanger for use with an upright post, comprising:

a substantially horizontal base plate;

a pole having an axis, and extending upright through a hole defined in the base plate;

a skirt located below the base plate for fixing the base plate atop the post;

a tubular sleeve located below and extending downward from the hole defined in the base plate;

a stop plate attached to an end of the sleeve distant from the base plate;

at least one arm extending from the pole for hanging objects from the hanger; and position retaining means for holding the pole in one of a number of specific, predetermined positions relative to the base plate.

7. A hanger as recited in claim 6, wherein the position retaining means comprises a projection attached to the pole above the base plate and a number of stops attached to the base plate and disposed radially about the pole; each stop being separated by a gap from an adjacent said stop; the projection being adapted to fit within each of the gaps.

8. A hanger for use with an upright post, comprising:

a substantially horizontal base plate;

a pole having an axis, and extending upright through a hole defined in the base plate;

a skirt located below the base plate for fixing the base plate atop the post;

a tubular sleeve located below and extending downward from the hole defined in the base plate;

a stop plate attached to an end of the sleeve distant from the base plate;

at least one arm extending from the pole for hanging objects from the hanger;

a projection attached to the pole above the base plate; and a number of stops attached to the base plate and disposed radially about the pole;

each stop being separated by a gap from an adjacent said stop; the projection being adapted to fit within each of the gaps.

* * * * *